US009840919B2

(12) United States Patent
Bayer et al.

(10) Patent No.: US 9,840,919 B2
(45) Date of Patent: Dec. 12, 2017

(54) METHOD FOR PRODUCING A RUN-IN COATING, A RUN-IN SYSTEM, A TURBOMACHINE, AS WELL AS A GUIDE VANE

(75) Inventors: Erwin Bayer, Dachau (DE); Thomas Hess, Munich (DE); Sven-J. Hiller, Erdweg (DE); Peter Geiger, Munich (DE)

(73) Assignee: MTU Aero Engines AG, Munich (DE)

( * ) Notice: Subject to any disclaimer, the term of this patent is extended or adjusted under 35 U.S.C. 154(b) by 497 days.

(21) Appl. No.: 14/233,663

(22) PCT Filed: Jul. 18, 2012

(86) PCT No.: PCT/DE2012/000731
§ 371 (c)(1),
(2), (4) Date: Jan. 17, 2014

(87) PCT Pub. No.: WO2013/010529
PCT Pub. Date: Jan. 24, 2013

(65) Prior Publication Data

US 2014/0161624 A1 Jun. 12, 2014

(30) Foreign Application Priority Data

Jul. 20, 2011 (DE) ..... 10 2011 110 927
Nov. 22, 2011 (DE) ..... 10 2011 086 775

(51) Int. Cl.
*F01D 5/00* (2006.01)
*F01D 5/28* (2006.01)
*F01D 21/00* (2006.01)
*F01D 21/04* (2006.01)

(52) U.S. Cl.
CPC ..... *F01D 5/288* (2013.01); *F01D 21/006* (2013.01); *F01D 21/04* (2013.01); *Y10T 29/49316* (2015.01)

(58) Field of Classification Search
CPC ..... F01D 5/288; F01D 21/006; F01D 21/04; F01D 11/001; F01D 11/122;
(Continued)

(56) References Cited

U.S. PATENT DOCUMENTS 5,238,364 A 8/1993 Kreitmeier
2008/0289315 A1 11/2008 Bart et al.
(Continued)

FOREIGN PATENT DOCUMENTS

DE 10 2006 049216 4/2008
DE 10 2009 040299 3/2009
(Continued)

*Primary Examiner* — Jason Shanske
*Assistant Examiner* — Kelsey Stanek
(74) *Attorney, Agent, or Firm* — Davidson, Davidson & Kappel, LLC

(57) ABSTRACT

A method for producing a run-in coating for a turbomachine for braking a rotor in the event of a shaft breakage, the run-in coating being formed as an integral, generative blade portion during a generative manufacture of a blade. A run-in system having an abradable ring that is configured circumferentially on a blade row and has a chamber-type material structure. A turbomachine having a run-in system of this kind, as well as a guide vane having such a run-in coating.

15 Claims, 4 Drawing Sheets

(58) Field of Classification Search
CPC ..... F01D 21/045; Y10T 29/49316; F05D 2300/90; F05D 2300/21; F05D 2300/601; F05D 2300/2118; F05D 2300/44; F05D 2300/603; F05D 2300/611; F05D 2300/614; F05D 2300/2102; F05D 2230/31; F05D 2240/121; F05D 2240/304; F05D 2260/90
USPC ..... 416/241 R, 173.6; 29/889; 415/9, 200, 415/209.3; 60/39.091
See application file for complete search history.

(56) References Cited

U.S. PATENT DOCUMENTS

2009/0126336 A1* 5/2009 Bart ..... F01D 21/006 60/39.091
2009/0304497 A1* 12/2009 Meier ..... F01D 11/001 415/170.1
2009/0317246 A1* 12/2009 Lutz ..... F01D 5/14 415/200
2011/0052412 A1 3/2011 Ader et al.
2012/0121431 A1* 5/2012 Jakimov ..... C23C 24/04 416/241 R
2012/0168049 A1* 7/2012 Jenkins ..... B60C 11/12 152/209.21
2012/0201691 A1* 8/2012 Dautl ..... B23K 26/34 416/241 R

FOREIGN PATENT DOCUMENTS

DE 102009057875 6/2011
WO 2007085230 8/2007

* cited by examiner

METHOD FOR PRODUCING A RUN-IN COATING, A RUN-IN SYSTEM, A TURBOMACHINE, AS WELL AS A GUIDE VANE

The present invention relates to a method for producing a run-in coating for a turbomachine for braking a rotor in response to a shaft breakage, a run-in system having a run-in coating of this type, a turbomachine having such a run-in system, as well as to a guide vane having a run-in coating of this type.

BACKGROUND

If a turbine component in a turbomachine, such as an aircraft engine, experiences a shaft breakage, the rotor must be prevented from moving uncontrollably out of the position thereof and from radially, respectively axially penetrating the housing surrounding it. For that reason, aircraft engines are generally provided with a run-in system that is supposed to brake the kinetic energy of the rotor by selectively, axially running in the shaft fragments to the point where no fragments can be hurled through the housing to the external environment. Known run-in systems are configured in the turbine, for example, between an outer shroud of a rotor blade row and the blades of a following guide vane row.

The U.S. Patent Application 2008/0289315 A1 describes an alternative run-in system where the downstream hub region of a rotor blade row has a circumferential toothed rim configured therein that engages into a guide vane-side run-in coating in response to a shaft breakage. This run-in system does, in fact, relieve the guide vane blades, however, the toothed rim also creates a plurality of point contacts between the toothed profile and the run-in coating. This run-in system can be produced in a mechanical machining process. Alternatively, a subsequent mounting of the toothed rim and a subsequent application of the run-in coating are possible. Moreover, both the mechanical machining, as well as the subsequent binding process constitute time-consuming manufacturing variants.

The U.S. Patent Application 2009/0126336 A1 describes a run-in system where a radially inner, guide vane-side, ring-shaped run-in coating is produced from a granular material by sintering under the action of temperature and pressure, respectively is subsequently bound. However, the sintering and, in particular, the subsequent binding of the run-in coating are relatively expensive. In particular, a faulty binding can lead to an abrasion, respectively breaking-away of the run-in coating, and, consequently, to an uncontrolled braking of the broken shaft pieces.

SUMMARY OF THE INVENTION

It is an object of the present invention to provide a method for producing a run-in coating for a turbomachine for braking a rotor in the event of a shaft breakage that overcomes the aforementioned disadvantages and is readily implemented. Moreover, it is an object of the present invention to provide a run-in system having a run-in coating that will make possible a selective braking of a broken shaft, and to provide a turbomachine, whose rotor is able to be braked in a controlled fashion in response to a shaft breakage, as well as a guide vane having a run-in coating.

It is an object of the present invention to provide a method according to the present invention for producing a run-in coating for a turbomachine for braking a rotor in the event of a shaft breakage, the run-in coating is formed as an integral, generative blade portion during a generative manufacture of the blades.

Due to the integral generative formation thereof, the run-in coating is produced in one step along with the blade, thereby eliminating a subsequent binding, respectively formation of the run-in coating. Moreover, the generative production of the run-in coating makes possible a flexible form and, in particular, a form and a positioning that render possible an optimal braking and optimal guidance of the rotor.

Moreover, by employing a generative production, individual process parameters may be adjusted to produce the run-in coating. The run-in coating may be hereby provided with a different internal structure, respectively material structure than the actual blade and thus be provided with its own specific properties. Thus, even in the case of a homogeneous material, the material structure and, thus, the structural stability of the run-in coating and of the blade may be optimally adapted to the specific technical requirements to be met.

A generative auxiliary structure may be constructed during manufacture of the blades to create a reference plane and/or a supporting structure that supports the blades during the manufacture thereof and is then removed following the manufacture of the blades. For example, the auxiliary structure is constructed along with the blades as pins that stabilize the same.

A run-in system according to the present invention has a plurality of integral, preferably generatively produced run-in coatings that form a closed or open abradable ring that extends over a blade row and has a chamber-type material structure. In this context, "chamber-type" signifies a porous, cellular, honeycomb-shaped, skeleton-type, latticework-type and similar material structure. In particular, "chamber-type" signifies a structurally weaker internal structure than a bearing structure accommodating the run-in coating and an abrasive element, such as an abrasive ring that runs into the run-in coatings, abrading the same. In accordance with the wording of the present invention, "closed" signifies a circumferentially closed formation of the abradable ring; the planes of separation, respectively the circumferential gaps of the adjacent run-in coatings being so small that they may be disregarded or closed by adapters suited for that purpose. The closed, respectively circumferential formation creates a circumferential braking surface and guide surface which make possible a reliable and rapid braking and thus at least greatly reduce damage to the rotor and housing structure. In this context, the chamber-type material structure prevents, inter alia, cracks from being introduced into a blade portion that accommodates the run-in coating. In addition, the chamber structure reduces the introduction of heat into the blade row when grazing contact is made. In accordance with the wording of the present invention, "open" signifies that the run-in coatings are circumferentially spaced apart.

To further minimize damage to the rotor structure during the run-in process, it is advantageous when the abradable ring is formed on the outer shroud side. This results, on the one hand, in an outer radial, stable support and, on the other hand, in an especially rapid kinetic energy absorption since the ring surface of the radially outer run-in coating is enlarged relative to a radially inner run-in coating. Moreover, the risk of damage to the rotor in essential regions is minimized as is, therefore, any endangerment of the rotor integrity.

It is possible to prevent the abradable ring from influencing the rotating mass of the rotor by configuring it on a guide vane row. One exemplary embodiment of a closed abradable ring provides for it to be configured on the leading sides of outer shrouds of the guide vanes.

One exemplary embodiment of an open abradable ring provides for it to be configured on the leading edges of guide vanes.

In addition, the chamber-type material structure of the abradable ring allows the trailing sides of outer shrouds of a rotor blade row to act as an abrasive ring that presses against the abradable ring in response to a shaft breakage. There is no need for a special formation, respectively hardening of the trailing sides or for special abrasive elements. Since the trailing sides have a planar form, a largest possible contact area is created when the abrasive ring runs onto the abradable ring, which, in particular, accelerates the braking.

To further optimize and guide the broken rotor, the abradable ring may feature different local material structures. For example, the abradable ring may be subdivided into layers that are optimally adapted in terms of structural engineering to individual braking phases. Thus, for example, a front layer may be used as a damping layer for shock absorption in response to the abrasive ring running onto the abradable ring, and may feature an appropriately soft material structure. On the other hand, a rear layer may have a solid material structure for optimizing the braking.

In the same way, the abradable ring may have different cross sections and thus be adapted alternatively or in combination with the local material structure to the particular technical requirement. For example, a ring region of the abradable ring may be in the form of a predetermined breaking point to achieve a fastest possible braking of the rotor in the case of a potential destruction of intact rotor structure portions in response to unexpectedly high forces.

A turbomachine according to the present invention has a run-in system having an integral, preferably generatively produced abradable ring and an abrasive ring for running onto the abradable ring in response to a shaft breakage, the abradable ring being disposed in the leading region of a guide vane row and having a chamber-type material structure, and the abrasive ring being formed of a rotor blade row facing opposite the abradable ring. A turbomachine of this type is distinguished by an optimal guidance and braking of a rotor in response to a shaft breakage. Any danger of fragments penetrating the housing of the turbomachine is prevented, respectively at least greatly reduced.

In a leading region, a guide vane according to the present invention has an integral run-in coating that features a chamber-type material structure and, thus, at least an optimal kinetic energy dissipation.

In one exemplary embodiment, the run-in coating is disposed on a leading side of an outer shroud and is circumferentially closed, thereby forming a largest possible friction surface between the run-in coating and the abradable ring.

In one alternative exemplary embodiment, the run-in coating is disposed radially outwardly on a leading edge of a blade and thus has an open form.

To additionally impede fragmentation of the rotor blades and guide vanes in the event of a shaft breakage, it is advantageous for the run-in coating to be disposed quasi in front of the blade. In one exemplary embodiment, this is achieved in that the run-in coating is displaced upstream, respectively forms an edge portion of the leading edge that is displaced upstream relative to a radially inner edge portion. Thus, the leading edge has a stepped form, the blade having a greater axial extent radially outwardly than radially inwardly due to the run-in coating. In addition, an axial distance is hereby reduced between the rotor blades and the guide vanes, whereby a frictional contact is rapidly produced, and a rapid braking is initiated.

BRIEF DESCRIPTION OF THE DRAWINGS

Preferred exemplary embodiments of the present invention are described in greater detail in the following with reference to greatly simplified schematic representations, in which.

DETAILED DESCRIPTION

Figure 1:
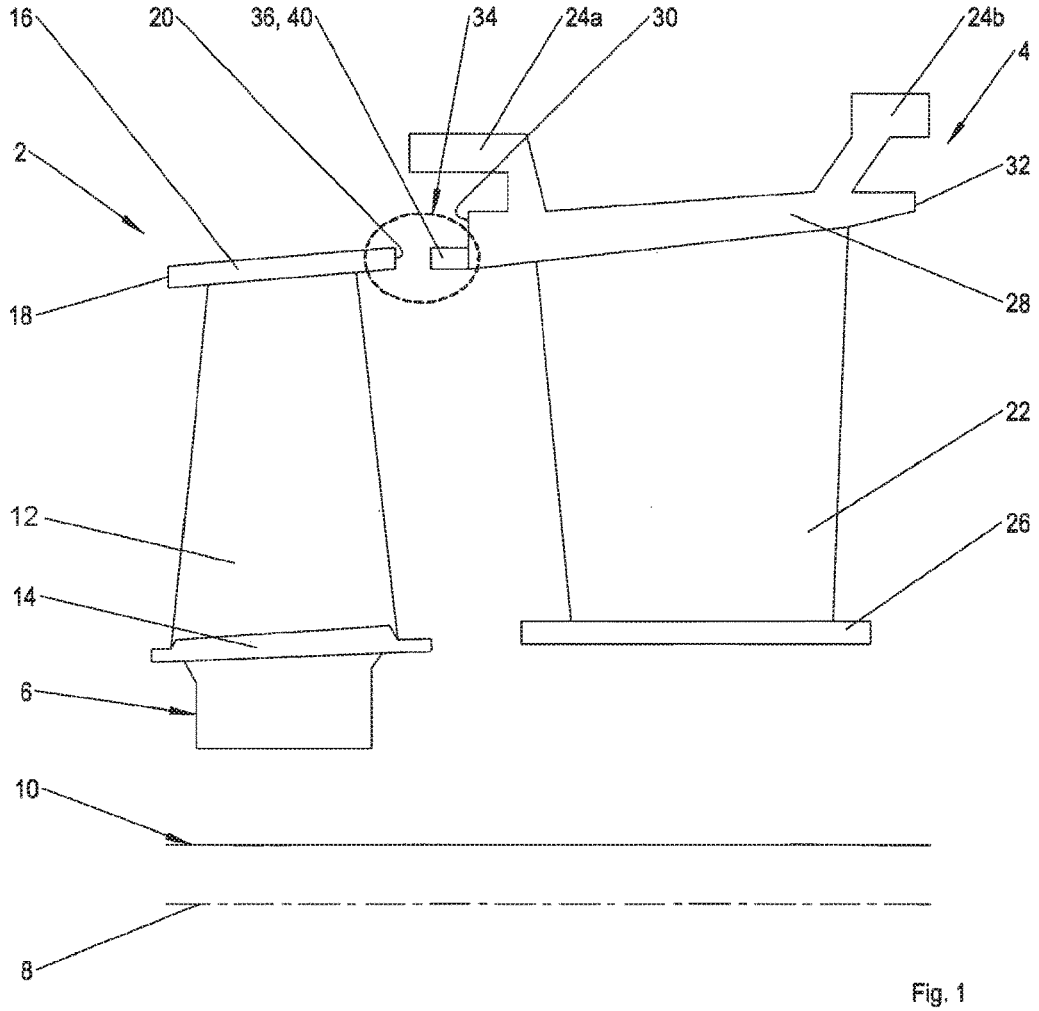
FIG. 1 shows a part section through a turbomachine including a first exemplary embodiment of a run-in system according to the present invention.

The part-sectional view in FIG. 1 shows a lateral view of a rotor blade 2 and of an adjacent downstream guide vane, respectively of a guide vane segment 4 of a rotor in the compressor of an aircraft engine.

Together with a multitude of other rotor blades, rotor blade 2 forms a rotor blade rim, respectively a rotor blade row that is configured via a hub 6 on the blade root side and a disk accommodating the same on a shaft 10 rotating about an axis of rotation 8. Rotor blades 2 each have a blade root 12 that is configured in an annular space between an inner shroud 14 and an outer shroud 16 of rotor blades 2. Shrouds 14, 16 each define the annular space traversed by a main flow and each have a leading side 18 oriented oppositely to the flow direction, as well as a trailing side 20 oriented in the flow direction.

In this exemplary embodiment, guide vanes 4 are each fixed in position by root portions 24*a*, 24*b* thereof in a housing-side recess. In alternative exemplary embodiments, guide vanes 4 are integrally included on or bolted to the housing. In correspondence with rotor blades 2, they each have a blade leaf 22 that is configured in an annular space between an inner shroud 26 and an outer shroud 28 of rotor blades 4 and that each feature an upstream oriented leading side 30 and a downstream oriented trailing side 32. However, when guide vanes 4 are combined into guide vane segments, a plurality of blades 22 are configured in each case between an inner shroud 26 and an outer shroud 28.

In accordance with the representation in FIG. 1, a run-in system 34 (marked by a dashed-line circle) for guiding and braking the rotor in response to a shaft breakage is configured between outer shrouds 16 of the rotor blade row and outer shrouds 28 of guide vane row. Run-in system 34 has an abradable ring 36 configured in the leading region of the guide vane row and an opposite abrasive ring 38 configured in the trailing region of the upstream rotor blade row that are mutually axially spaced apart in the case of an undamaged rotor. In this first exemplary embodiment, abradable ring 36 and abrasive ring 38 are circumferentially closed.

Figure 2:
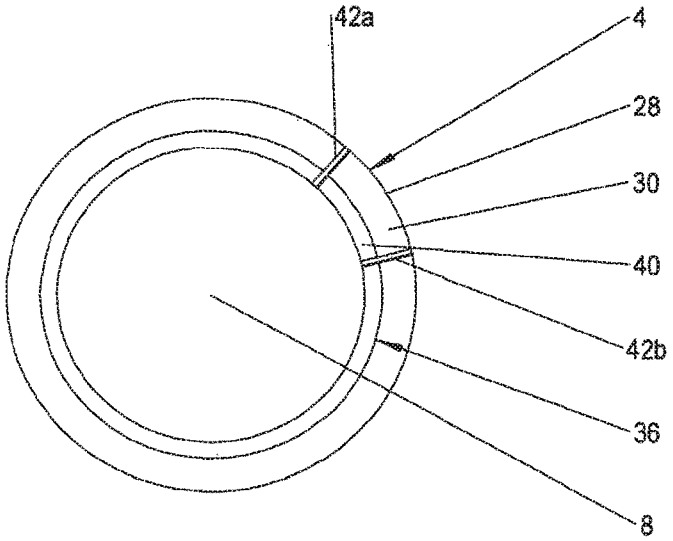
FIG. 2 shows an axial plan view of a leading region of a guide vane row.

As shown in FIG. 2, abradable ring 36 is formed by a multitude of preferably generatively produced run-in coatings 40 that are configured on the leading sides 30 of outer shrouds 28 as integral blade portions and are mutually laterally spaced apart across a narrow circumferential gap 42*a*, 42*b*. For the sake of clarity, merely two circumferential gaps 42*a*, 42*b* are shown that may be closed using adapters suited for that purpose. Thus, each run-in coating 40 forms a ring segment of abradable ring 36 and covers only a radially inner region of leading sides 30.

Figure 3:
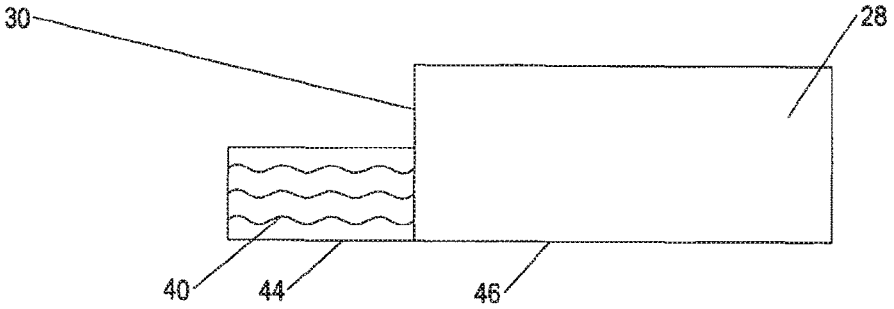
FIG. 3 is a lateral detailed representation of the leading region.

As shown by the detail view in FIG. 3, run-in coatings 40 have a chamber-type material structure. In this context, "chamber-type" signifies a porous, cellular, honeycomb-shaped, skeleton-type, latticework-type and similar material structure. In particular, "chamber-type" signifies a structurally weaker internal structure than a bearing structure accommodating run-in coating 40 and an abrasive element, such as abrasive ring 38, that runs into run-in coatings 40, abrading the same. They merge transitionally by a peripheral surface 44 facing the annular space into a cylindrical or conical shroud surface 46 facing the annular space. They have a maximum radial extent that corresponds to a radial extent, respectively thickness of outer shrouds 16 of rotor blades 2 in the region of trailing edges 20 thereof (see FIGS. 5 and 6).

Figure 4:
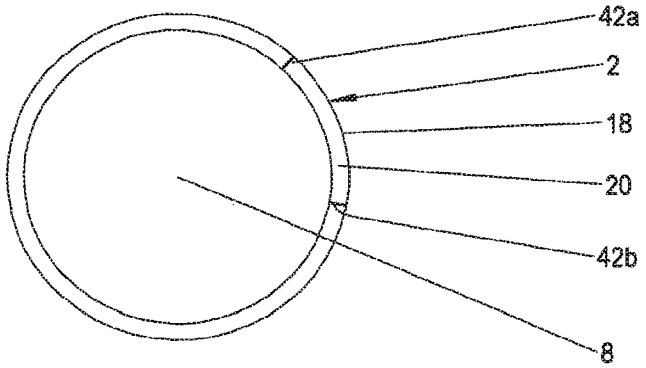
FIG. 4 shows a plan view of a rotor blade row in the region of the outer trailing edges thereof.

Abrasive ring 38 indicated in FIG. 4 is formed by outer trailing sides 20 of rotor blades 2. Rotor blades 2 are likewise mutually spaced apart, in each case across a small circumferential gap 42*a*, 42*b* that may be closed using adapters suited for that purpose. Abrasive ring 38 is made of a harder material than abradable ring 36 and thus leads to an ablation of abradable ring 36 in response to a shaft breakage.

Figure 5:
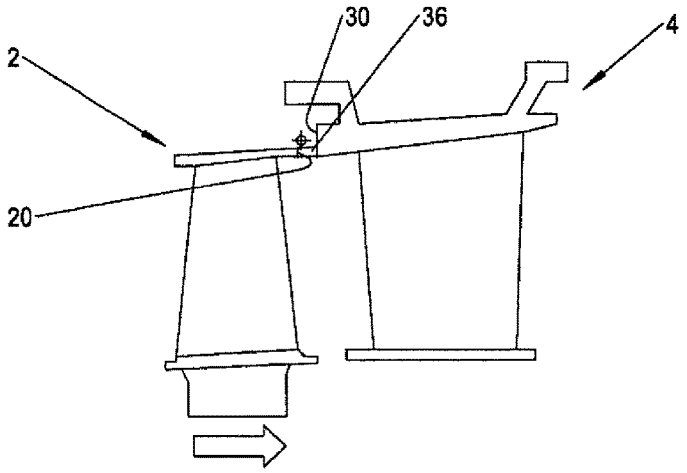
FIGS. 5 and 6 illustrate methods of functioning of the run-in system in the event of a shaft breakage.
Figure 6:
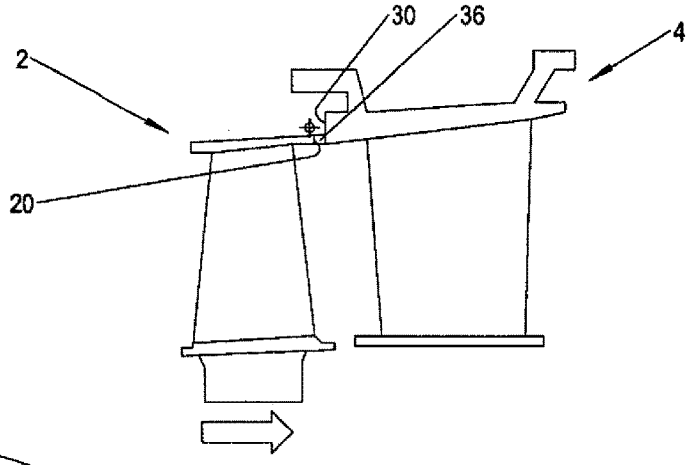

As shown in FIG. 5, in response to a shaft breakage, rotor blades 2 run onto abradable ring 36 of guide vanes 4 via abrasive ring 38 thereof and thus directly via trailing sides 20 thereof forming abrasive ring 38, in the direction of flow in accordance with the arrow. Abrasive ring 38 rubs into run-in coating 36, whereby the rotor is braked, and abradable ring 36 is abraded, respectively worn down, at least in portions thereof, as shown in FIG. 6. In this context, abradable ring 36 has such a chamber-type material structure and such an axial extent that outer shrouds 16 of rotor blades 2 are prevented from running directly by trailing sides 20 thereof onto leading sides 30 of outer shrouds 28 of guide vanes 4. Any fragmentation of rotor blades 2 and/or of guide vanes 4 is thereby effectively prevented.

Figure 7:
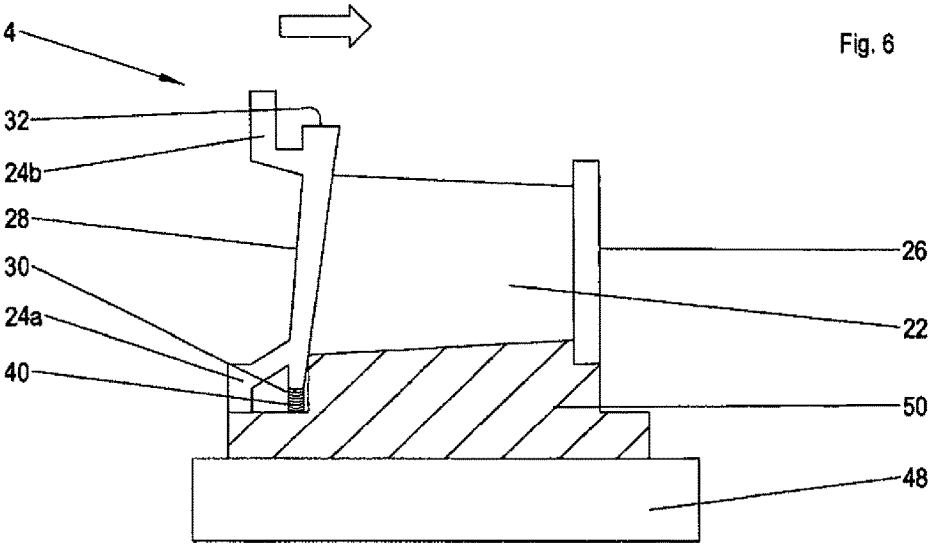
FIG. 7 illustrates a method for producing a run-in coating according to the present invention.

As shown in FIG. 7, run-in coatings 40 are integrally produced with particular guide vane 4 in a generative process. To this end, a suitable metal powder is deposited in layers onto a base plate 48, and an auxiliary structure 50 marked by hatched shading is produced by a high-energy beam, such as an electron beam or a laser beam. The high-energy beam is guided in tracks over the top powder layer, whereby it is melted thereon and bonded to the preceding powder layer. Auxiliary structure 50 makes it possible to compensate for unevenness of base plate 48, for example, and permits a step-by-step construction of overlying structures and, thus, the creation of a defined reference plane for particular guide vane 4. In addition, auxiliary structure 50 acts as a support for stabilizing guide vanes 4 during the generative production.

By modifying the process parameters, guide vanes 4 in question are constructed generatively in layers, horizontally from leading side 30 to trailing side 32, together with integrated run-in coating 40, during production of auxiliary structure 50. Once particular guide vane 4 is completely constructed, it is separated from auxiliary structure 50.

The chamber-type material structure of run-in coatings 38 is produced by varying the manufacturing parameters and thus by employing process parameters that are individualized relative to the other blade portions, such as root portions 24*a*, 24*b*, shrouds 26, 28, as well blade 22, respectively blades 22 in the case of rotor blade segments.

Figure 8:
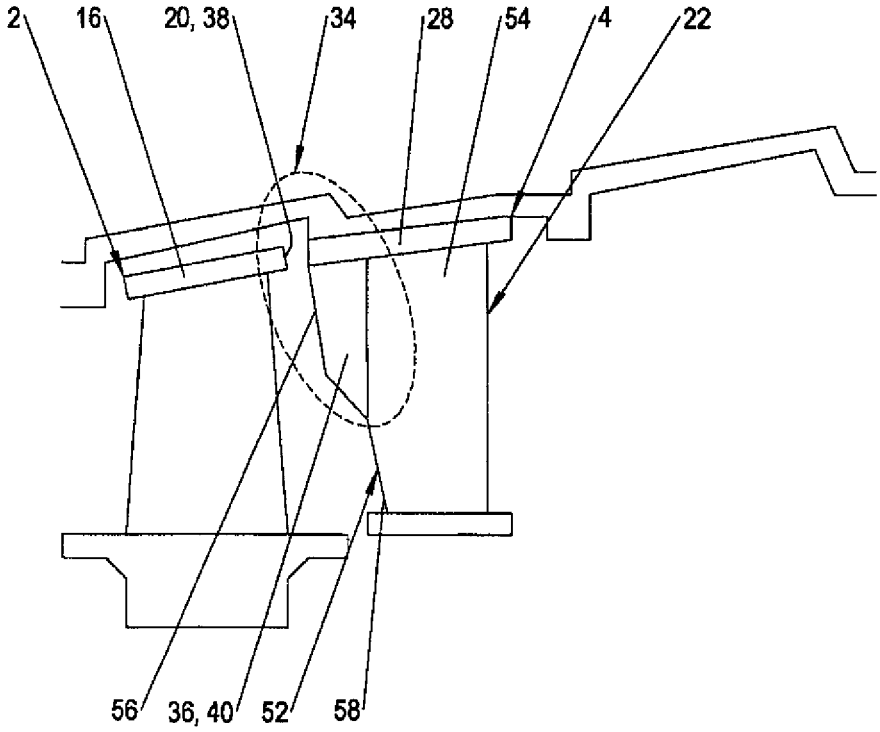
FIG. 8 shows a part section through a turbomachine having a second exemplary embodiment of the run-in system according to the present invention.

A second exemplary embodiment of run-in system 34 according to the present invention is shown in FIG. 8. In contrast to the first exemplary embodiment, an abradable ring 36 is configured at leading edges 52 of blades 22 or guide vanes 4 and thus has an open form over the circumference of the guide vane row. Run-in coatings 40 forming abradable ring 36 are provided with the greatest axial extent thereof radially outwardly and thus in the region of an opposing abrasive ring 38. They have a chamber-type, respectively cellular, porous, honeycomb-shaped and similar material structure, as described above, and are generatively formed together with guide vanes 4. The material structure of the other blade region 54 is of the conventional type and is thus provided with a structurally harder internal structure than run-in coating 40. Run-in coatings 40 are disposed quasi in front of the particular blade 22, whereby leading edges 52 each have a radially outer, respectively outer shroud-proximate edge portion 56 that is displaced upstream in relation to a radially inner edge portion 58. Thus, leading edge 52 has a stepped form.

Abrasive ring 38 of the upstream rotor blade row is identical to abrasive ring 38 in accordance with the first exemplary embodiment. Thus, abrasive ring 38 is likewise formed of outer shroud-side trailing sides 20 of the upstream rotor blade row and is made of a harder material than abradable ring 36.

The method of functioning is identical to that of the first exemplary embodiment. In response to a shaft breakage, rotor blades 2 run onto open abradable ring 36 of guide vanes 4 via abrasive ring 38 thereof and thus directly via trailing sides 20 thereof forming abrasive ring 38. Abrasive ring 38 rubs into run-in coating 36, respectively partially abrades the same, whereby the rotor is braked. The chamber-type material structure and the axial extent of abradable ring 36 prevent outer shrouds 16 from running directly onto blade region 54. Thus, any fragmentation of the rotor blades and/or of the guide vanes is effectively prevented.

Blade-side run-in coatings 50 are generatively, integrally produced during manufacture of guide vanes 4, so that reference is made to the above explanations pertaining to FIG. 7.

A method is described for producing a run-in coating for a turbomachine for braking a rotor in the event of a shaft breakage; the run-in coating being formed as an integral blade portion in the context of a blade manufacture; a run-in system having an abradable ring having a chamber-type material structure configured circumferentially on a blade row, a turbomachine having such a run-in system, as well as a guide vane having a run-in coating of this type.

LIST OF REFERENCE NUMERALS

2 rotor blade
4 guide vane
6 hub
8 axis of rotation
10 shaft
12 blade root
14 inner shroud

16 outer shroud
18 leading side
20 trailing side
22 blade leaf
24*a, b* root portion
26 inner shroud
28 outer shroud
30 leading side
32 trailing side
34 run-in system
36 abradable ring
38 abrasive ring
40 run-in coating
42*a, b* circumferential gap
44 peripheral surface
46 shroud surface
48 base plate
50 auxiliary structure
52 leading edge
54 blade region
56 outer edge portion
58 inner edge portion

What is claimed is:

1. A method for producing a run-in coating for a turbomachine for braking a rotor in the event of a shaft breakage, comprising:

forming the run-in coating as an integral blade portion during a generative manufacture of a blade, wherein the generative manufacture includes forming the blade and the run-in coating through deposition and melting of metal powder in layers.

2. The method as recited in claim 1 further comprising constructing a generative structure during manufacture of the blade and removing the structure following the manufacture of the blade.

3. The method of claim 1, wherein the run-in coating forms an abradable ring, and the abradable ring includes a plurality of run-in coatings mutually laterally spaced apart by circumferential gaps which together form an integral, closed or open abradable ring having a chamber-type material structure.

4. The method of claim 1, wherein each run-in coating includes a damping layer for shock absorption and a braking layer for optimizing braking.

5. A run-in system comprising an integral, closed or open abradable ring including a plurality of run-in coatings mutually laterally spaced apart by circumferential gaps along the circumference of the abradable ring, the run-in coatings forming the abradable ring extending over a rotor blade row and located axially between outer shrouds of the rotor blade row and outer shrouds of a guide vane row and having a chamber-type material structure.

6. The run-in system as recited in claim 5 wherein the abradable ring is formed either on a side of the outer shrouds of the rotor blade row opposite a side of the outer shrouds of the guide vane row, or on a side of the outer shroud of the guide blade row opposite a side of the outer shroud of the rotor vane row.

7. The run-in system as recited in claim 5 wherein the abradable ring is placeable on leading sides of outer shrouds of the guide vane row.

8. The run-in system as recited in claim 5 wherein the abradable ring is placeable on leading edges of guide vanes.

9. The run-in system as recited in claim 5 wherein an abrasive ring is configurable for running onto the abradable ring of trailing sides of outer shrouds of the rotor blade row in response to a shaft breakage.

10. The run-in system as recited in claim 5 wherein the run-in coatings are manufactured in accordance with the method recited in claim 1.

11. A turbomachine comprising the run-in system as recited in claim 5, and an abrasive ring for running onto the abradable ring in response to a shaft breakage, the abradable ring being disposed in the leading region of the guide vane row, and the abrasive ring being formed in the upstream trailing region of a rotor blade row opposite the abradable ring.

12. A guide vane row comprising a plurality of guide vanes, each guide vane including an outer shroud and an inner shroud; and an abradable ring in a leading region of the guide vane, wherein the abradable ring includes a plurality of run-in coatings mutually laterally spaced apart by circumferential gaps along the circumference of the abradable ring, the plurality of run-in coatings having a chamber-type material structure.

13. The guide vane as recited in claim 12 wherein the run-in coatings are formed on a leading side of the outer shrouds.

14. The guide vane as recited in claim 12 wherein the run-in coatings are formed radially outwardly on a leading edge of a blades of each guide vane.

15. The guide vane as recited in claim 12 wherein the run-in coatings are formed on an edge portion of a leading edge displaced upstream relative to a radially inner edge portion of each guide vane.

* * * * *